US006394847B2

(12) United States Patent
Law

(10) Patent No.: US 6,394,847 B2
(45) **Date of Patent: *May 28, 2002**

(54) FUSE STAB CONNECTOR FOR ELECTRONIC MODULES

(75) Inventor: Perry Law, Centerville, UT (US)

(73) Assignee: EFI Electronics, INC, Salt Lake City, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/235,878

(22) Filed: Jan. 22, 1999

(51) Int. Cl.[7] ..... H01R 13/68
(52) U.S. Cl. ..... 439/621; 439/250; 439/830
(58) Field of Search ..... 439/621, 830, 439/249, 250; 361/833, 835, 626, 628, 630, 642, 646

(56) References Cited

U.S. PATENT DOCUMENTS

| | | | | | |
|---|---|---|---|---|---|
| 3,744,003 | A | * | 7/1973 | Dipace | 439/622 |
| 5,018,991 | A | * | 5/1991 | Katz et al. | 430/621 |
| 5,515,023 | A | * | 5/1996 | Marach et al. | 439/622 |
| 5,820,413 | A | * | 10/1998 | Yamada et al. | 439/621 |
| 5,984,728 | A | * | 11/1999 | Chen et al. | 439/620 |

* cited by examiner

*Primary Examiner*—Tulsidas Patel
(74) *Attorney, Agent, or Firm*—David R. Stacey; Larry T. Shrout; Larry I. Golden

(57) ABSTRACT

A fuse stab connector for electronic modules is described in which a fuse is associated with an electronic module so that the connector for the fuse to a circuit also serves as an electromechanical connector of a module to the fuse, a primary circuit, and primary circuit mechanical structure.

12 Claims, 3 Drawing Sheets

FUSE STAB CONNECTOR FOR ELECTRONIC MODULES

BACKGROUND

The present invention relates generally to apparatus for connecting two electrical circuits by using a fuse coupled at each respective end with a clip or stab connector from each respective circuit.

It has long been known to connect a cylindrical fuse in an electrical circuit or line by means of clip connectors. That is, by attaching a clip at either end of the fuse. Such connectors normally comprise two prongs biased toward the central axis of the fuse. The clips often have a rounded portion that conforms to the circumference of the mating conductor at either end of the fuse. This type of clip is depicted as prior art in FIG. 1 of U.S. Pat. No. 5,361,026, LOAD INDICATING SOCKET TESTER to Preuhs et al., and is well known in the art. In the event the fuse fails, the clips make replacement relatively simple.

It is also known to connect electrical components, modules or circuits, by means of one or more stab connectors, also known as blade connectors. Stab connectors are normally comprised of a male and female component. The female component is often additionally comprised of two conductive prongs divided by a space. A bias urges the prongs toward the space. An electrically conductive male member is inserted between prongs at the space to complete a connection between the modules. The female component is electrically and, in the case of a geometrically separate module, mechanically, associated with one component, line or system, and, the male with another. A closed circuit can be established by associating the male with the female portion. Alternatively, the circuit can be opened by disassociating the male and female components. Examples of such stab connectors are described in U.S. Pat. No. 2,709,793, ELECTRIC CONNECTOR HAVING JAWS TO RECEIVE A CONTACT BLADE to Johansson; and, U.S. Pat. No. 5,334,057, CONNECTORS FOR ELECTRICAL METER SOCKET ADAPTORS to Blackwell.

It is also known in the art to associate a fuse electrically between two circuits, such as between a power distribution circuit and a surge suppression circuit. This has a particular advantage when the surge suppression circuit has a closed fail state. When the surge suppression device fails in such an arrangement, electrical energy is conducted to neutral to form a short circuit. The fuse opens the circuit. A fuse in such a system is a relatively inexpensive component.

When Surge suppressive circuits fail, it is desirable to replace them with new operative circuitry. Such circuits often comprise diagnostic and indicative sub-circuitry, housings, and other components that could be desirably discarded and replaced upon failure of the core components such as metal oxide varistors.

As a fuse and the spent surge suppression circuitry operate together, it would be advantageous to remove, discard, and replace them as a module.

Modular surge suppression circuits are often connected to a power distribution circuit with a screw or stab connector as described above. In the case of a surge suppressive plug strip, they are often hardwired with solder, screw, or crimp connections to a conductor between two common plugs of the "wall plug" type. The fuse can be connected to such a circuit by means of solder or two of the clips described herein above.

As the fuse in the system immediately described above is desirably replaced with the system, and as such fuses are configured for ease of replacement, it would be desirable to combine the features that allow ease of replacement of the fuse, with ease of replacement of a surge suppression module. A line distribution system may require a fuse independent of desirable surge suppression. In this instance, the fuses and surge suppression circuits compete geometrically for replacement accessibility. They also unnecessarily duplicate connecting means.

Stab connectors for conducting high currents for fuses and high currents and voltages for surge suppression, have high volumes of conductive metals which make them relatively expensive.

Electronic modules must also normally be held in geometric proximity to the structure and circuitry with which they are to be associated. This may be accomplished by nonconductive means, such as screws tapped into an insulating housing, straps, or other conventional means.

There is thus a need to provide a combination fuse and stab connector which eliminates duplicative heavy connectors for both fuses and suppression modules, combines the geometry of the fuse and suppression module such that both are readily accessible, and allows both to be replaced simultaneously upon failure of either. There is a further need to provide an electrical connector that also serves to hold the module in place mechanically with respect to the circuit and structure with which it is to be associated.

Those having ordinary skill in the art will appreciate that these and other needs are met by the present invention.

OBJECTS AND SUMMARY OF THE INVENTION

It is therefore an object of the present invention to provide a fuse stab connector that will also effect connection of an associated electronic module.

It is a further object of the present invention to provide a connector that eliminates duplication of expensive conductive components by combining the connective functions of fuses and modules.

It is yet a further object of the present invention to provide such an electrical connector that also serves as a mechanical attachment for the module.

The above objects and others not specifically recited are realized in specific illustrative embodiments of a fuse stab connector in which a fuse is associated with an electronic module in such a way that the electrical connection of the fuse to the circuit also serves as a mechanical attachment of the module to the circuit.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENTS OF THE PRESENT INVENTION

Figure 1:
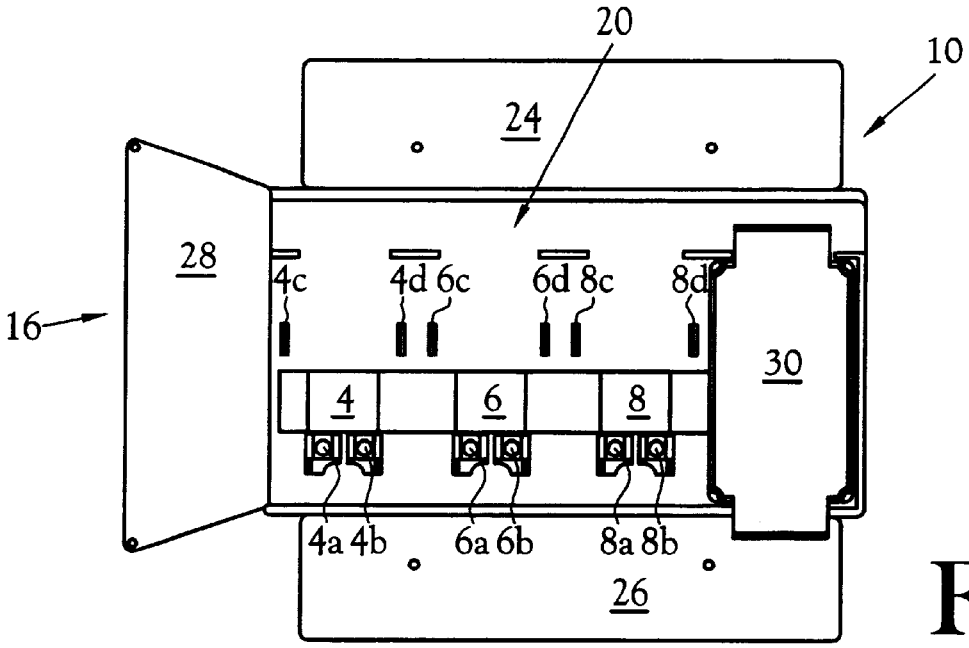
FIG. 1 is a plan view of a power distribution circuit box in which the circuit has three phases, a ground and neutral, each having clips for connection to a service module and a single service module attached.

Reference will now be made to the drawings wherein like structures will be provided with like reference numerals.

Figure 5:
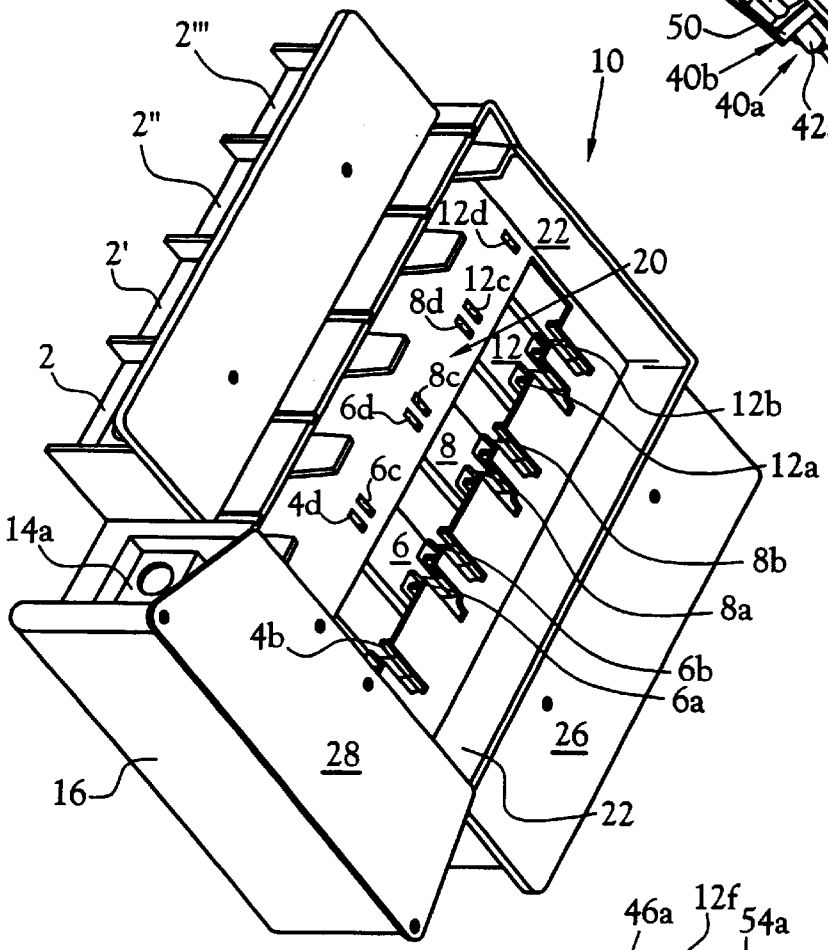
FIG. 5 is a perspective view of the power distribution circuit box of FIG. 1; and, FIG. 6 is a schematic diagram of the surge suppression modules of FIGS. 2–4 in conjunction with a power distribution circuit and box of FIGS. 1 and 5.

Referring to FIGS. 1 and 5, there is shown, generally designated at 10, a power distribution circuit box. The box has a well generally depicted at 20 in which surge suppression modules 30 (FIG. 1) can be placed. FIG. 1 depicts one such module 30 fixed in position in the well 20. Three more would normally be in place, but are not depicted so as to provide a view to underlying structure.

Figure 6:
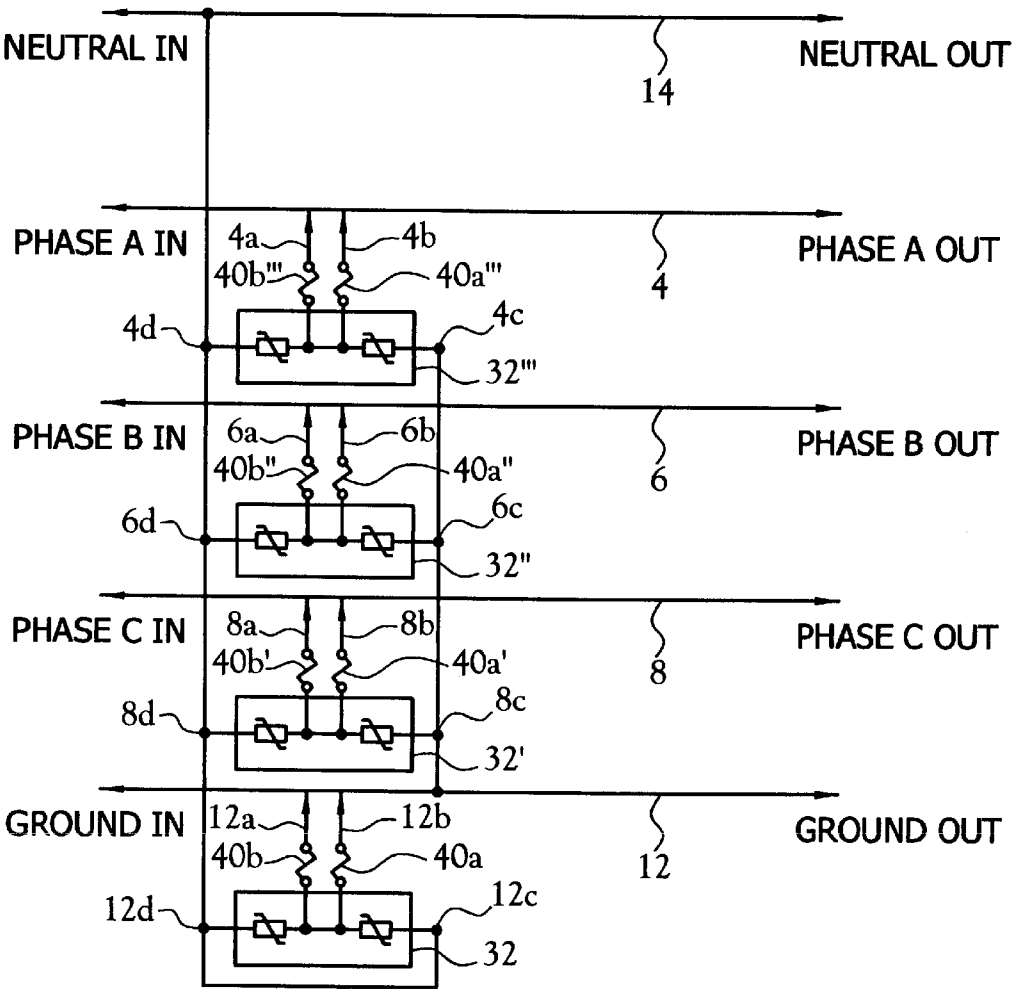

Line connectors for the power distribution lines are depicted at 2–2''' (FIG. 5). Opposing connectors for the other in/out lines (not in view) are opposite connectors 2–2'''. In this system, these line connectors would be used for a ground line, and phase lines A–C (FIG. 6). It will be appreciated that different power distribution systems will have differing numbers and configurations of lines associated with corresponding numbers of modules 30. There is also a compression connector 14*a* which connects to a neutral line 14 (see FIG. 6) with associated circuitry within housing 16.

Connectors 2–2''' are associated respectively with a pair of clips: connector 2 with 4*a–b*; connector 2' with 6*a–b*; connector 2'' with 8*a–b*; and, connector 2''' with 12*a–b*. As will be described, these clips have mating structure associated with FIGS. 2–4.

The clips are bolted or, preferably, riveted to bus bars, having corresponding numbers, 4–8 and 12 respectively. Bus bars 4–8 and 12 complete circuits between connectors 2–2''' and their opposing connectors respectively.

Common neutral connections are provided. Female stab receptacles 4*d*, 6*d*, 8*d*, and 12*c–d* are connected in series to line 14 (FIG. 6) via a screw-type compression connector 14*a*. Common ground connections are also provided. Female stab receptacles 4*c*, 6*c*, and 8*c* are connected in series to ground line 12. Stab prongs which mate with female receptacles 4*c–d*, 6*c–d*, 8*c–d*, and 12*c–d* will be described in conjunction with FIGS. 2–4.

A skirt 22 is provided around the periphery of well 20 to provide an insulating barrier around the well. This prevents arcing of high voltage and reduces the potential for accidental contact. Covers 24, 26 and 28 provide similar barriers as well to provide attachment points for appurtenant structure.

Figure 2:
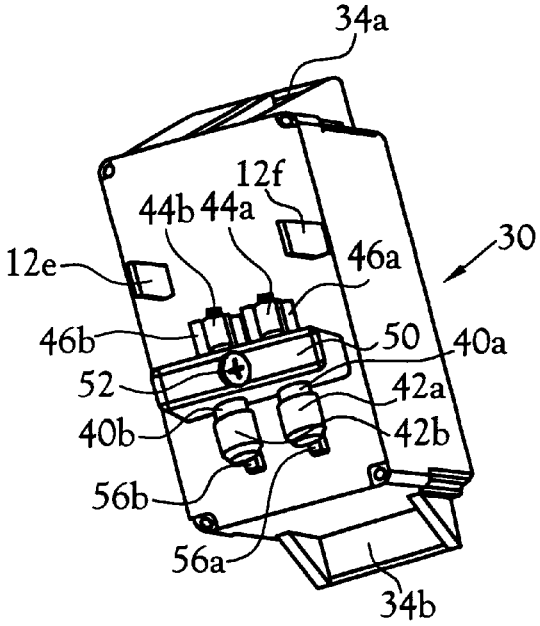
FIG. 2 is a perspective view of a service module for mating with FIG. 1.
Figure 3:
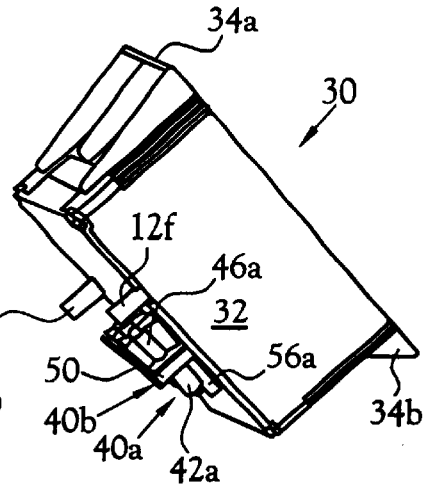
FIG. 3 is another perspective view of the module of FIG. 2.
Figure 4:
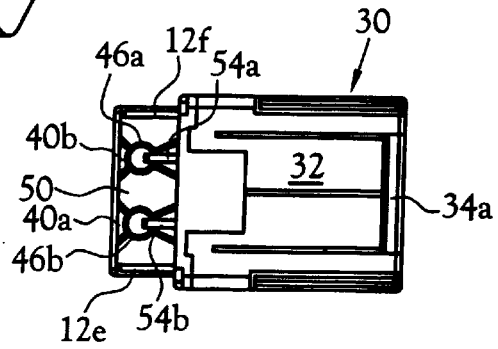
FIG. 4 is a top view of the module of FIGS. 2 and 3.

Turning now to FIGS. 2–4, wherein a surge protection module is depicted generally at 30. The module is essentially surrounded by an insulating housing 32. Attached to either end or the housing 32, at the outfacing surface, are grasping handles 34*a–b*, which are used to grasp the module 30 for ease of removal from the well 20 of the power distribution box 10. Protruding from the housing on an in-facing surface are stab prongs 12*e* and 12*f*. Stab prong 12*e* mates with stab receptacle 12*d* and Stab prong 12*f* mates with stab receptacle 12*d*. The drawings depict a single module 30 but it will be appreciated that each of three more identical modules would be used in conjunction with the power distribution box 10. The only difference is that the prongs would be numbered in the 4–8 series. All structure would be identical to 30.

Also depicted in FIGS. 2–4 are fuses 40*a* and 40*b*. The fuses are cylindrical having a central cylindrical insulator to cover internal structure (not depicted) known in the art. The fuses also have conductive bands 42*a* and 42*b* at one end, and opposing conductive bands 44*a* and 44*b* at the opposite end.

Also attached to the module 30 and extending through its housing 32, are two clips 46*a–b*, which conductively attach each fuse 40*a–b* to the circuitry of the module (see FIG. 6).

A yoke 50 surrounds a longitudinally central area of the cylinder of fuses 40*a–b* to hold them to the in-facing surface of the housing 32 of the module 30. The yoke 50 is attached to the module by means of a screw 52 (FIG. 2). Thus the fuses 40*a–b* are fixedly attached to the module 30. Longitudinal fuse retainers 54*a–b* are also provided as an integral feature of the module housing 32. Lateral supports 50*a–b* are also provided integral with the housing 32.

Importantly, when the module 30 is inserted into a corresponding site within the well 20 (again, it will be appreciated that module 30 may go in any of the four sites with no structural modification), the fuse terminuses or conductive bands 42*a* and 42*b* mate respectively with clips 12*a* and 12*b*. The described mating establishes an electromechanical connection between the box 10 and the module 30. As the clips (4*a–b*, 6*a–b*, 8*a–b* and 12*a–b*) have a natural inward bias and a curvature complementary to the fuse cylinder, it takes considerable force to overcome insertion and removal forces. Such forces are primarily frictional in nature. It will be appreciated that a strong bias also helps to establish good electrical contact. The complementary curves of the prongs of the various clips, increases contact area with similar results.

Now, turning to FIG. 6 wherein is depicted a schematic diagram of the essential circuitry of the device previously described. It will be appreciated that appurtenant circuitry such as diagnostics for the surge suppression module could be included in such a device. Similar reference numerals have been supplied to structure already described, which descriptions are incorporated here by reference. Additionally, reference numerals 4, 6, 8, 12 and 14 are added to the respective power lines for ease of cross reference. All four modules are depicted here and prime, prime-prime and prime-prime-prime have been added to the housing 32 and fuses 40*a–b*, though they would be identical in structure to that depicted in FIGS. 2–4.

It will be appreciated that fuses 40 and varisters described in the presently preferred embodiment are connected in parallel in series pairs, but could, as well, be connected in parallel singularly, or in series in greater than pairs.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A power distribution apparatus comprising:

a module including a module circuit having a plurality of connection points defined by at least one fuse clip, said at least one module fuse clip configured to receive a first end of a fuse; and a circuit box including a main circuit having a plurality of connection points defined by at least one fuse clip, said at least one circuit box fuse clip configured to receive a second end of the fuse held by said module fuse clip;

whereby the fuse completes an electrical connection between said module circuit and said main circuit when said module is releasably secured in said circuit box and the electrical connection between said main circuit and said module circuit is broken when said module is removed from said circuit box.

2. The power distribution apparatus of claim 1 further comprising a yoke configured to secure the fuse to said module.

3. The power distribution apparatus of claim 2 wherein said yoke releasably secures the fuse to said module.

4. The power distribution apparatus of claim 1 wherein said module circuit plurality of connection points is further defined by at least one stab connector and said main circuit plurality of connection points is further defined by at least one stab connector, said main circuit stab connector configured to releasably engage said module stab connector in electromechanical connection.

5. The power distribution apparatus of claim 4 wherein said at least one module stab connector and said at least one main circuit stab connector are selected from the group consisting of stab prongs and stab receptors.

6. The power distribution apparatus of claim 1 wherein said module circuit is a transient voltage surge suppression circuit.

7. A replaceable module for connecting to a main circuit having a plurality of connection points defined by at least one fuse clip, said replaceable module comprising:

a module housing;

a module circuit disposed within said module housing; and at least one module fuse clip in electrical communication with said module circuit and configured to receive and to secure one end of a fuse externally to said module housing, said at least one module fuse clip disposed such that, when said replaceable module is connected to said main circuit, a second end of the fuse secured by said at least one module fuse clip is received and secured by a corresponding at least one main circuit fuse clip;

whereby the fuse completes an electrical connection between said module circuit and said main circuit when said module is releasably secured in said circuit box and the electrical connection between said main circuit and said module circuit is broken when said module is removed from said circuit box.

8. The replaceable module of claim 7 wherein said module circuit is a transient voltage surge suppression circuit.

9. The replaceable module of claim 7 further comprising a yoke configured to secure the fuse to said module housing.

10. The replaceable module of claim 9 wherein said yoke releasably secures the fuse to said module housing.

11. The replaceable module of claim 7 wherein the main circuit plurality of connection points also includes at least one stab connector, said replaceable module further comprising at least one stab connector in electrical communication with said module circuit and extending from said module housing such that, when said replaceable module is connected to said main circuit, said at least one module stab connector engages a corresponding at least one main circuit stab connector in a releasable electromechanical connection.

12. The power distribution apparatus of claim 11 wherein said at least one module stab connector and said at least one main circuit stab connector are selected from the group consisting of stab prongs and stab receptors.

* * * * *